US009552712B2

(12) United States Patent
Doyle et al.

(10) Patent No.: US 9,552,712 B2
(45) Date of Patent: Jan. 24, 2017

(54) SYSTEMS AND METHODS FOR NOTIFYING USERS OF VEHICLE CONDITIONS

(71) Applicant: Verizon Patent and Licensing Inc., Arlington, VA (US)

(72) Inventors: Sean Raymond Doyle, Cumming, GA (US); Thomas Taylor, Atlanta, GA (US); Dwight Hartman, Peachtree City, GA (US); Manikandan Palanimuthu, Johns Creek, GA (US)

(73) Assignee: VERIZON PATENT AND LICENSING INC., Basking Ridge, NJ (US)

( * ) Notice: Subject to any disclaimer, the term of this patent is extended or adjusted under 35 U.S.C. 154(b) by 0 days.

(21) Appl. No.: 14/546,579

(22) Filed: Nov. 18, 2014

(65) Prior Publication Data

US 2016/0140824 A1 May 19, 2016

(51) Int. Cl.

*G08B 21/02* (2006.01)
*G08B 21/18* (2006.01)
*G08B 21/22* (2006.01)

(52) U.S. Cl.

CPC ..... *G08B 21/02* (2013.01); *G08B 21/18* (2013.01); *G08B 21/22* (2013.01)

(58) Field of Classification Search

CPC ..... G08B 21/02; G08B 21/18; G08B 21/22; B60N 2/02; B60N 2/26

See application file for complete search history.

(56) References Cited

U.S. PATENT DOCUMENTS 5,793,291 A * 8/1998 Thornton ..... B60N 2/002 340/425.5
5,949,340 A * 9/1999 Rossi ..... B60N 2/002 340/425.5
6,028,509 A * 2/2000 Rice ..... G08B 21/02 340/425.5
6,480,103 B1 * 11/2002 McCarthy ..... B60Q 3/06 340/425.5
6,639,512 B1 * 10/2003 Lee ..... G08B 21/02 340/425.5
6,819,249 B1 * 11/2004 Papp ..... B60N 2/002 307/10.1
2008/0316043 A1 * 12/2008 Gomes ..... B60N 2/28 340/686.6
2014/0253313 A1 * 9/2014 Schoenberg ..... B60N 2/28 340/457
2014/0265480 A1 * 9/2014 Perrin ..... B60N 2/26 297/217.4
2014/0335902 A1 * 11/2014 Guba ..... H04W 4/027 455/456.4
2015/0137962 A1 * 5/2015 Binnicker ..... B60Q 9/00 340/457

* cited by examiner

*Primary Examiner* — Van Trieu

(57) ABSTRACT

Systems and methods are disclosed for notifying users of vehicle conditions. According to certain embodiments, the system comprises at least one processor configured to determine whether an ambient temperature associated with a vehicle exceeds a temperature threshold and detect a sound associated with the vehicle. The at least one processor is further configured to output a notification based on the determined ambient temperature and detected sound.

20 Claims, 5 Drawing Sheets

SYSTEMS AND METHODS FOR NOTIFYING USERS OF VEHICLE CONDITIONS

BACKGROUND

Vehicle telematics technologies have greatly improved the driving experience in recent years. For example, the incorporation of global positioning system (GPS) technology into vehicles has enabled drivers to navigate to their destinations more safely and efficiently. Hands-free cellular communications have allowed drivers to communicate with others more safely by minimizing the distractions associated with operating a handheld cellular phone. Numerous other benefits are provided by vehicle telematics, including roadside assistance, theft protection and vehicle recovery, and internal climate control.

Many of these technologies help improve the safety and comfort of users' experiences while driving, but safety is also a concern while a vehicle is shut off. For example, the climate inside a vehicle may become very dangerous for a child or pet that is left unattended, particularly on a hot day. Moreover, whereas current theft protection systems may provide some defense against vehicle theft, these systems fail to take advantage of the full potential of vehicle telematics. Aspects of the disclosed embodiments address these and other concerns regarding vehicle safety and security.

SUMMARY

Consistent with the present disclosure, systems and methods are provided for notifying users of vehicle conditions. Embodiments consistent with the present disclosure include computer-implemented systems and methods for notifying users associated with a vehicle when an ambient temperature associated with the vehicle exceeds a temperature threshold and a sound associated with the vehicle is detected. Embodiments consistent with the present disclosure may overcome one or more of the drawbacks or problems set forth above.

In accordance with some example embodiments, a computerized method is provided for notifying users of vehicle conditions. The method is performed by one or more processors and comprises determining whether an ambient temperature associated with a vehicle exceeds a temperature threshold. The method further includes detecting a sound associated with the vehicle. Moreover, the method includes outputting a notification based on the determined ambient temperature and detected sound.

In accordance with some example embodiments, a system is provided for notifying users of vehicle conditions. The system comprises at least one processor configured to determine whether an ambient temperature, inside or outside a vehicle, associated with the vehicle exceeds a temperature threshold. The at least one processor is further configured to detect a sound associated with the vehicle, typically the sound emanating from within the vehicle. Moreover, at least one processor is configured to output a notification based on the determined ambient temperature and detected sound.

Before explaining certain embodiments of the present disclosure in detail, it is to be understood that the disclosure is not limited in its application to the details of construction and to the arrangements of the components set forth in the following description or illustrated in the drawings. The disclosure is capable of embodiments in addition to those described and of being practiced and carried out in various ways. Also, it is to be understood that the phraseology and terminology employed herein, as well as in the abstract, are for the purpose of description and should not be regarded as limiting.

As such, it is appreciated that the conception and features upon which this disclosure is based may readily be utilized as a basis for designing other structures, methods, and systems for carrying out the several purposes of the present disclosure. It is important, therefore, to recognize that the claims should be regarded as including such equivalent constructions insofar as they do not depart from the spirit and scope of the present disclosure.

BRIEF DESCRIPTION OF THE DRAWINGS

The accompanying drawings, which are incorporated in and constitute part of this specification, and together with the description, illustrate and serve to explain the principles of various example embodiments.

DETAILED DESCRIPTION

Figure 1:
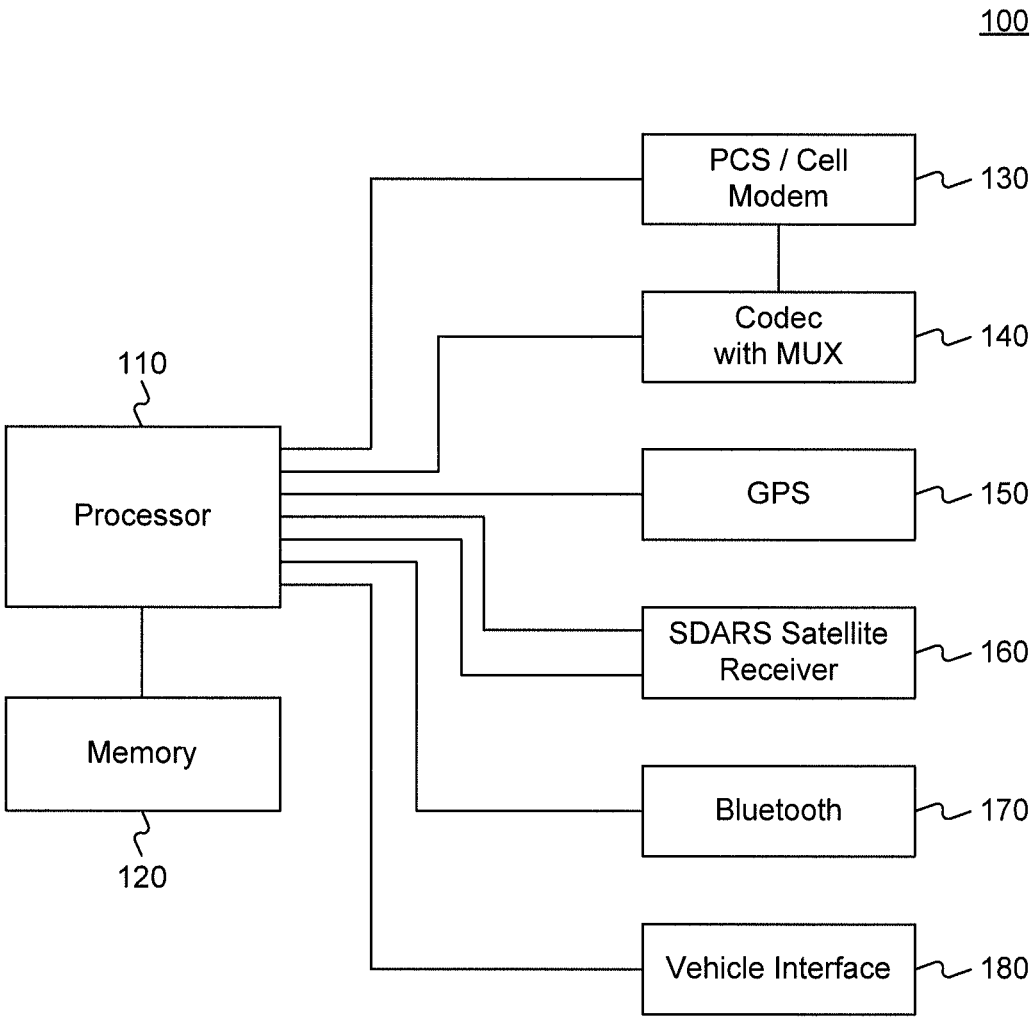
FIG. 1 is a diagram of an example telematics unit, in accordance with embodiments of the present disclosure.

Reference will now be made in detail to the example embodiments implemented according to the disclosure, the examples of which are illustrated in the accompanying drawings. Wherever possible, the same reference numbers will be used throughout the drawings to refer to the same or like parts.

Embodiments of the present disclosure provide improved systems and methods for notifying users of vehicle conditions. The disclosed embodiments detect whether potentially unsafe conditions exist in a vehicle and notify a user of the vehicle of the conditions. In some embodiments, a telematics unit determines whether an ambient temperature within a vehicle exceeds a threshold temperature. When the ambient temperature exceeds a threshold temperature, the telematics unit sends a request to an auxiliary unit to monitor sound within the vehicle. If the auxiliary unit detects a sound exceeding a threshold decibel value, the auxiliary unit reports this sound to the telematics unit, which in turn notifies a user of the vehicle regarding the detected sound.

In other embodiments, additional conditions may affect whether the telematics unit requests that the auxiliary unit monitors sounds within the vehicle or whether the auxiliary unit reports a detected sound to the telematics unit. For example, in addition to checking whether the ambient temperature exceeds a threshold value, the telematics unit may also check whether the vehicle is in an off state, whether the vehicle is locked, whether a child seat in the vehicle is occupied, and the distance of the user from the vehicle. Moreover, the auxiliary unit may record sounds within the vehicle and report detected sounds to the telematics unit if the recorded sounds match an audio signature, such as a child crying, a pet barking, or glass breaking.

The embodiments herein include computer-implemented methods, tangible non-transitory computer-readable mediums, and systems. The computer-implemented methods may be executed, for example, by at least one processor that receives instructions from a non-transitory computer-readable storage medium. Similarly, systems consistent with the present disclosure may include at least one processor and memory, and the memory may be a non-transitory computer-readable storage medium. As used herein, a non-transitory computer-readable storage medium refers to any type of physical memory on which information or data readable by at least one processor may be stored. Examples include random access memory (RAM), read-only memory (ROM), volatile memory, nonvolatile memory, hard drives, CD ROMs, DVDs, flash drives, disks, and any other known physical storage medium. Singular terms, such as "memory" and "computer-readable storage medium," may additionally refer to multiple structures, such a plurality of memories or computer-readable storage mediums. As referred to herein, a "memory" may comprise any type of computer-readable storage medium unless otherwise specified. A computer-readable storage medium may store instructions for execution by at least one processor, including instructions for causing the processor to perform steps or stages consistent with an embodiment herein. Additionally, one or more computer-readable storage mediums may be utilized in implementing a computer-implemented method. The term "computer-readable storage medium" should be understood to include tangible items and exclude carrier waves and transient signals.

FIG. 1 depicts a diagram of an example telematics unit for implementing embodiments of the present disclosure. Telematics unit 100 may be installed in a vehicle, such as a personal or commercial vehicle. In some embodiments, the components of telematics unit 100 are contained within a single box and controlled with a single core processing subsystem. In other embodiments, the telematics unit 100 is comprised of components distributed throughout a vehicle. Each of the components of telematics unit 100 may be separate subsystems of the vehicle, for example, a communications component such as a SDARS, or other satellite receiver, may be coupled with an entertainment system of the vehicle.

Telematics unit 100 comprises one or more communications components, such as PCS/Cell Modem 130 and SDARS receiver 160 (or other satellite receiver). PCS/Cell Modem 130 may provide a variety of types of communications, including but not limited to GPRS, EDGE, LTE, UMTS, 1×RTT or EV-DO. PCS/Cell Modem 130 may be a Wi-Fi or mobile WIMAX implementation that may support operation on both licensed and unlicensed wireless frequencies. Telematics unit 100 may also include a location-determining component such as a global positioning system (GPS) receiver 150, which may receive position information from GPS satellites and aid in determining the location of the receiver 150. Moreover, telematics unit 100 may include a Bluetooth-compatible transceiver 170, or other short range wireless communication interface that may enable the telematics unit to interface with devices such as phones, headsets, music players, telematics user interfaces, and other auxiliary devices.

Telematics unit 100 further comprises one or more processors 110, which control various components of telematics unit 100. Processor 110 may be coupled to removable/non-removable, volatile/non-volatile computer storage media. For example, FIG. 1 illustrates memory 120, coupled to processor 110, which may provide non-volatile storage of computer code, computer readable instructions, data structures, program modules, and other data for telematics unit 100. Memory 120 may be a hard disk, a removable magnetic disk, a removable optical disk, magnetic cassettes or other magnetic storage devices, flash memory cards, CD-ROM, digital, versatile disks (DVD), Blu-ray discs (BD), or other optical storage, random access memories (RAM), read only memories (ROM), electrically erasable programmable read-only memory (EEPROM), and the like. Processor 110 may utilize PCS/Cell Modem 130 to transmit data over a wired or a wireless network. The data may be routed through the Internet to remote devices, such as a mobile phone associated with a user of a vehicle or an emergency services center. Moreover, processor 110 may utilize Bluetooth transceiver 170 to transmit information to and from nearby devices, such as a mobile phone or auxiliary unit located within or nearby a vehicle. Processor 110 may also transmit data to and from a user interface device, such as an infotainment (radio) head or touchscreen liquid crystal display (LCD) or light-emitting diode (LED) display device in the console of a vehicle, which may provide telematics information to the user and receive inputs used to configure components of telematics unit 100.

Processor 110 may also control other components within telematics unit 100 to allow for ease of integration into vehicle systems. Processor 110 may control power to the components of telematics unit 100. For example, power 110 may shut off GPS receiver 150 and SDARS receiver 160 when the vehicle is inactive or shut off PCS/Cell Modem 130 to conserve the vehicle battery when the vehicle is stationary for a long period. Processor 110 may utilize codec and multiplexer 140 to record sounds from within the vehicle and transmit the sounds, for example, to a mobile device of a user associated with the vehicle or to an emergency services center. Codec and multiplexer 140 may be coupled to one or more microphones (not shown) to facilitate speech recognition and sound recording. Moreover, codec and multiplexer 140 may be coupled to one or more speakers (not shown) to reproduce sounds, such as audio communications received via PCS/Cell Modem 130.

Telematics unit 100 may interface and monitor various vehicle systems and sensors to determine vehicle conditions through vehicle interface 180. Vehicle interface 180 may include, but is not limited to, ODB (On Board Diagnostics) port, OBD-II port, CAN (Controller Area Network) port, and the like. A cable may be used to connect the vehicle interface 180 to a vehicle. The vehicle interface 180 allows the telematics unit 100 to receive data indicative of vehicle performance, such as vehicle trouble codes, operating temperatures of the engine, ambient temperatures of the passenger area of the vehicle, operating pressures, speed, fuel air mixtures, oil quality, oil and coolant temperatures, wiper and light usage, mileage, brake pad conditions, and any data obtained from any discrete sensor that contributes to the operation of the vehicle engine and drive-train computer. Data obtained by telematics unit 100 through vehicle interface 180 may be transmitted via PCS/Cell Modem 130 to a central monitoring station, an emergency services center, a mobile device associated with a user of the vehicle, or any other remote device.

Figure 2:
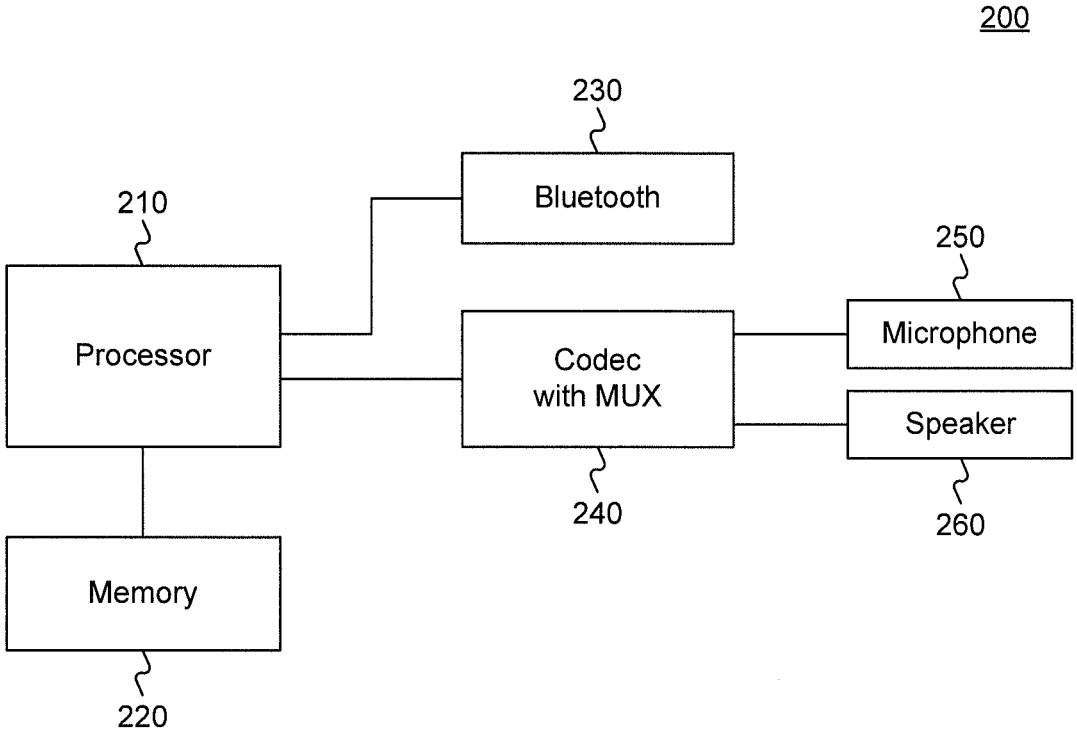
FIG. 2 is a diagram of an example auxiliary unit, in accordance with embodiments of the present disclosure.

FIG. 2 depicts a diagram of an example auxiliary unit for implementing embodiments of the present disclosure. Auxiliary unit 200 may be installed in a vehicle, such as a personal or commercial vehicle. In some embodiments, auxiliary unit 200 may be a small component that may be clipped or mounted within the passenger area of a vehicle.

For example, auxiliary unit 200 may be clipped to the visor above the driver's seat in the vehicle.

Auxiliary unit 200 further comprises one or more processors 210, which control various components of auxiliary unit 200. Processor 210 may be coupled to removable/non-removable, volatile/non-volatile computer storage media. For example, FIG. 2 illustrates memory 220, coupled to processor 210, which may provide non-volatile storage of computer code, computer readable instructions, data structures, program modules, and other data for auxiliary unit 200. Memory 220 may be a hard disk, a removable magnetic disk, a removable optical disk, magnetic cassettes or other magnetic storage devices, flash memory cards, CD-ROM, digital, versatile disks (DVD), Blu-ray discs (BD), or other optical storage, random access memories (RAM), read only memories (ROM), electrically erasable programmable read-only memory (EEPROM), and the like. Processor 210 may utilize Bluetooth transceiver 230 to transmit information to and from nearby devices, such as a telematics unit or a mobile device located within or nearby the vehicle.

Processor 210 may also utilize a codec and multiplexer 240 for receiving and/or recording sounds from within the vehicle. In particular, codec and multiplexer 240 may be coupled to microphone 250 to receive sounds from passengers in the vehicle. These sounds may be processed by the processor and transmitted to telematics unit 100 or to a mobile device (e.g., a user's mobile phone) via Bluetooth transceiver 230 for further processing, storage, and/or forwarding. Codec and multiplexer 240 may also reproduce sounds to the passengers in the vehicle through speaker 260. For example, speaker 260 may reproduce sounds received from telematics unit 100 or a mobile device via Bluetooth transceiver 240.

Figure 3:
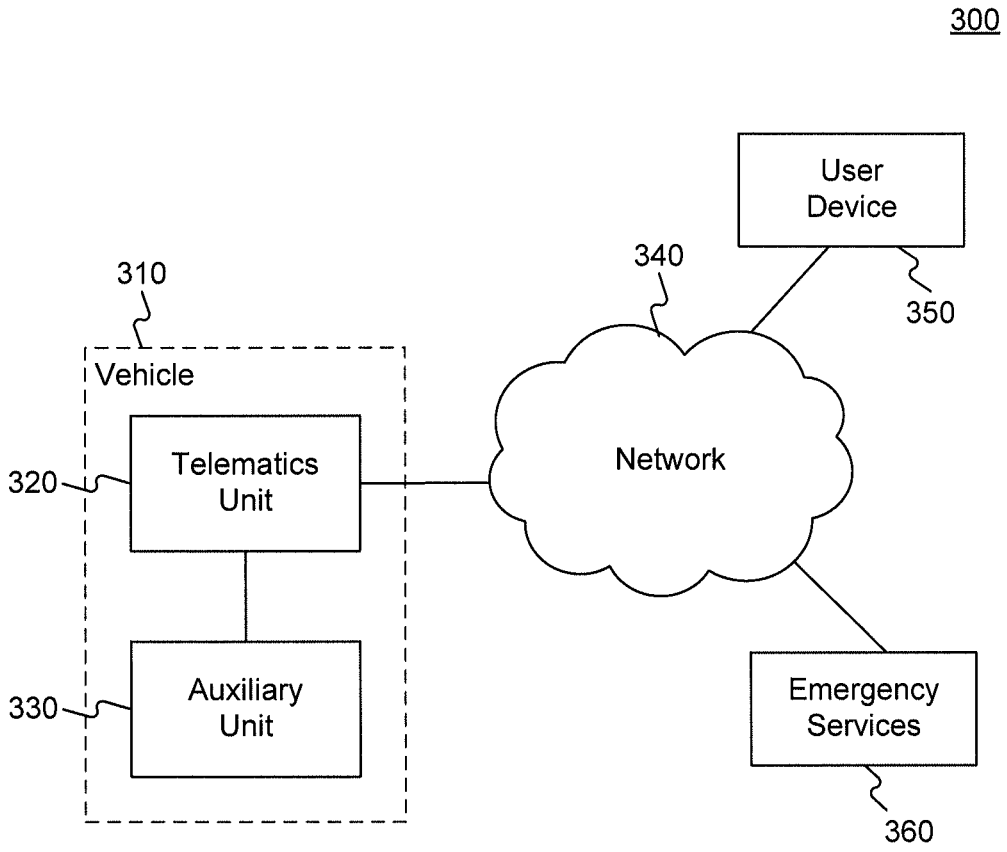
FIG. 3 is a diagram of an example system environment for implementing embodiments consistent with the present disclosure.

FIG. 3 depicts an example system environment for implementing embodiments of the present disclosure. The example embodiment of FIG. 3 depicts a system environment 300, which includes a vehicle 310, network 340, user device 350, and emergency services 360. As shown in FIG. 3, vehicle 310 may include a telematics unit 320, such as telematics unit 100 of FIG. 1, and an auxiliary unit 330, such as auxiliary unit 200 of FIG. 2. Moreover, telematics unit 320 is coupled to user device 350 and emergency services 360 via network 340, which may comprise the Internet. Telematics unit 320 may further be coupled to auxiliary unit 330 via Bluetooth.

According to certain embodiments, telematics unit 320 and/or auxiliary unit 330 may be used to notify a user device 350 and/or emergency services 360 via network 340 of certain conditions of vehicle 310. For example, telematics unit 320 and/or auxiliary unit 330 may be used to notify a user device 350 and/or emergency services 360 via network 340 that a child or pet may be currently unattended in a hot, stationary vehicle 310. As another example, telematics unit 320 and/or auxiliary unit 330 may be used to notify a user device 350 and/or emergency services 360 via network 340 that vehicle 310 may have been vandalized.

Figure 4:
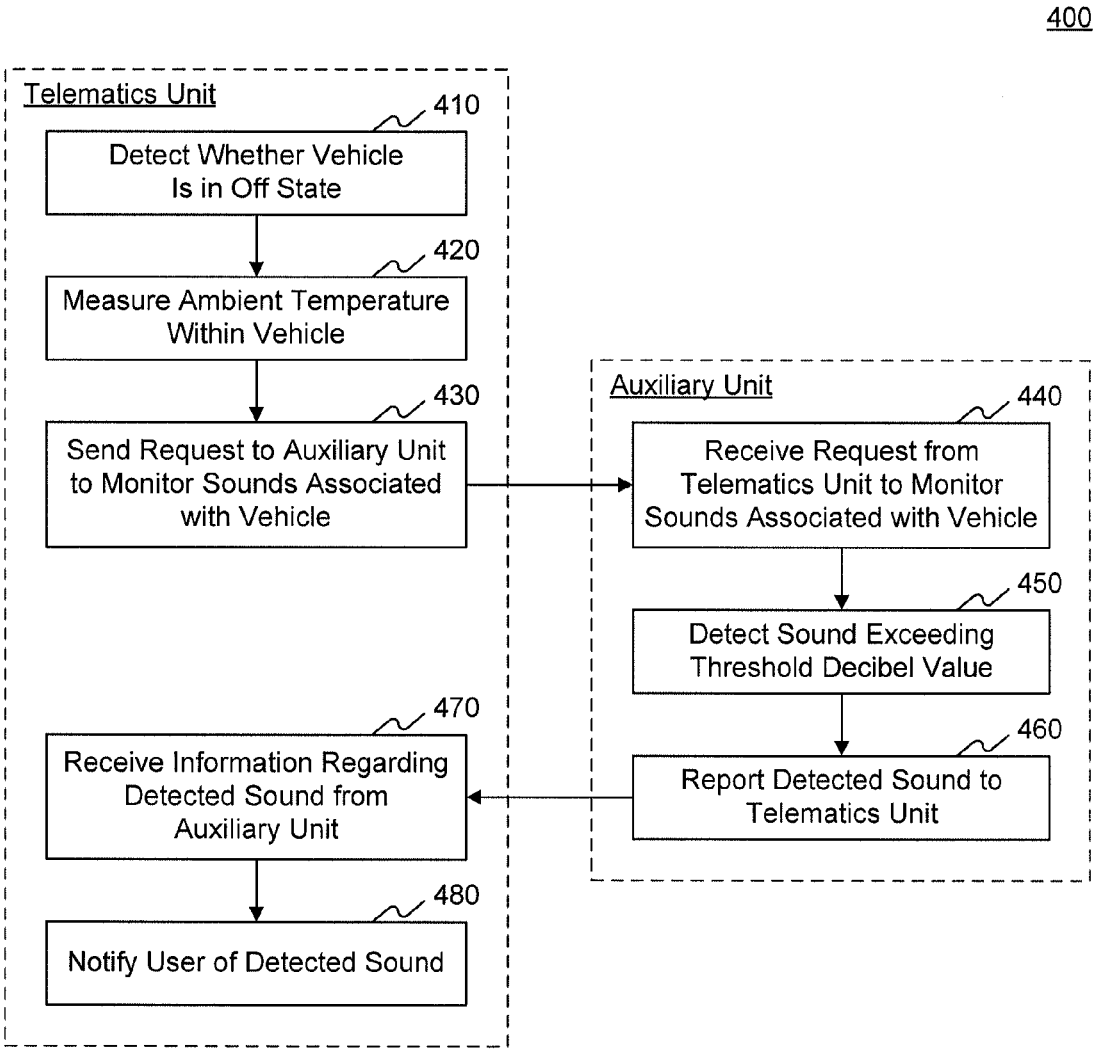
FIG. 4 illustrates an example process for notifying users of vehicle conditions, in accordance with embodiments of the present disclosure.

FIG. 4 depicts an example process 400 for notifying users of vehicle conditions, in accordance with some embodiments of the present disclosure. The steps associated with this example process may be performed by the components of FIG. 1, FIG. 2, and/or FIG. 3, although in the following description reference is made to certain components of FIG. 3 for purposes of illustration. It will be appreciated, however, that other implementations are possible and that components other than that illustrated in FIG. 3 may be utilized to implement the example method of FIG. 4.

In step 410, a telematics unit (e.g., telematics unit 320) detects whether a vehicle (e.g., vehicle 310) is in an off state. The telematics unit measures an ambient temperature within the vehicle at step 420. At step 430, the telematics unit determines whether certain potentially dangerous conditions exist in the vehicle. For example, the telematics unit may determine (1) whether the vehicle is in an off state and (2) whether the measured ambient temperature within the vehicle exceeds a threshold temperature (e.g., 100 degrees Fahrenheit). If the measured ambient temperature within the vehicle exceeds a threshold temperature, the telematics unit sends a request to an auxiliary unit (e.g., auxiliary unit 330) via Bluetooth (e.g., using Bluetooth transceiver 170) to monitor sound within the vehicle.

In some embodiments, the telematics unit only sends a request to the auxiliary unit to monitor sound within the vehicle if additional conditions are satisfied. For example, the telematics unit may send the request to the auxiliary unit to monitor sound within the vehicle only if the vehicle has been in an off state for a threshold duration (e.g., twenty minutes) as of the time that the measured ambient temperature exceeds the threshold temperature. In one embodiment, the telematics unit may send the request to the auxiliary unit to monitor sound within the vehicle only if the vehicle is locked. In another embodiment, the telematics unit may send the request to the auxiliary unit to monitor sound within the vehicle only if a child seat within the vehicle is occupied (e.g., a safety belt associated with the child seat is fastened).

In yet another embodiment, the telematics unit may determine a location of the vehicle (e.g., using a GPS, such as GPS 150), determine a location of a user associated with the vehicle (e.g., based on the location of the user's mobile device), and measure a distance between the vehicle and the user associated with the vehicle. In this embodiment, the telematics unit may send the request to the auxiliary unit to monitor sound within the vehicle only when the measured distance between the vehicle and the user associated with the vehicle is greater than a threshold distance (e.g., 20 yards).

At step 440, the auxiliary unit receives a request from the telematics unit to monitor sound within the vehicle. For example, the auxiliary unit may receive the request from the telematics unit via Bluetooth (e.g., using Bluetooth transceiver 230). In some embodiments, receiving this request wakes the auxiliary unit from a standby state. The auxiliary unit may monitor sound within the vehicle using a microphone (e.g., microphone 250). The auxiliary unit detects a sound exceeding a threshold decibel value at step 450. At step 460, the auxiliary unit reports the detected sound to the telematics unit (e.g., via Bluetooth).

In some embodiments, upon detecting a sound exceeding a threshold decibel value, the auxiliary unit records sounds within the vehicle. For example, the auxiliary unit may receive sounds via a microphone, process the sounds (e.g., using codec with mux 240), and save the sounds to memory (e.g., memory 220) using a processor (e.g., processor 210). The auxiliary unit may send the recorded sounds to the telematics unit. For example, the auxiliary unit may send the recorded sounds to the telematics unit when the auxiliary unit reports a sound exceeding a threshold decibel value.

According to certain embodiments, the auxiliary unit stores one or more audio signatures (e.g., in memory 220). For example, the auxiliary unit may store a first audio signature representing a baby crying, an second audio signature representing a dog barking, and a third audio signature representing a glass window breaking. The telematics unit may compare the sounds recorded within the vehicle to the one or more audio signatures to determine whether the recorded sounds match one of the audio signatures. If the recorded sounds match one of the audio signatures (e.g., if the recorded sound matches the audio signature representing a baby crying), then the auxiliary unit reports the detected sound to the telematics unit. If the recorded sound does not match a stored audio signature (e.g., the recorded sound is the ring of a cell phone left in the vehicle), then the auxiliary unit will not report the detected sound to the telematics unit.

The telematics unit receives information regarding the detected sound from the auxiliary unit (e.g., via Bluetooth) at step 470. In some embodiments, the received information may include the sounds recorded by the auxiliary unit. At step 480, the telematics unit notifies a user associated with the vehicle of the detected sound. In some embodiments, the telematics unit notifies the user by sending a text message, instant message, or email with information regarding the detected sound (e.g., time, ambient temperature, sound duration) to a mobile device associated with a user of the vehicle. In other embodiments, the telematics unit notifies the user by initiating a voice call that provides a prerecorded message alerting the user of a potentially hazardous condition or a customized message with information regarding the detected sound (e.g., time, ambient temperature, sound duration).

The telematics unit may also send an audio file containing the recorded sounds over network 340 to user device 350. For example, the telematics unit may send the audio file containing the recorded sounds in a text message or instant message to the user's mobile device or the telematics unit may play the recorded sounds during a voice call to the user's mobile device alerting the user of the potentially hazardous condition. In some embodiments, the telematics unit may notify emergency services (e.g., emergency services 360) of the potentially hazardous condition (e.g., via text message, instant message, email, or voice call). In these embodiments, the telematics unit may also send an audio file containing the recorded sounds to emergency services.

In other embodiments, the telematics unit lowers a window of the vehicle (e.g., by one inch) in response to receiving information regarding the detected sound, such as to release heat from the vehicle and bring the temperature below the threshold temperature level. In still other embodiments, the telematics unit activates the air conditioning of the car to cool the ambient temperature of the car to a temperature below the threshold temperature level.

In an example implementation of the disclosed systems and methods for notifying users of vehicle conditions, a telematics unit and an auxiliary unit may be provided in a vehicle. The telematics unit may be hidden, for example, behind the dash or console of the vehicle. The auxiliary unit may be visible and placed in an area where it may clearly receive and reproduce sounds. For example, the auxiliary unit may be clipped to the visor above the driver's seat.

When the driver of the vehicle arrives at a destination, such as a store, the driver shuts off the vehicle, exits the vehicle, locks the vehicle doors, and walks into the store. The telematics unit and auxiliary unit may enter standby states after the user powers off the vehicle. Some functions of the telematics unit and auxiliary unit, however, may remain active. For example, the telematics unit may continue to monitor the ambient temperature within the vehicle after the vehicle is shut off.

After the driver has been in the store for thirty minutes, the telematics unit may detect that the ambient temperature within the vehicle has exceeded 100 degrees Fahrenheit. In response, the telematics unit sends a request to the auxiliary unit to monitor sound within the vehicle. The auxiliary unit receives the request from the telematics unit, which wakes the auxiliary unit from a standby state. Once active, the auxiliary unit begins monitoring sounds within the vehicle.

For example, the driver's dog, which was accidentally left behind in the vehicle when the driver went into the store, begins barking in the backseat of the vehicle. The auxiliary unit detects the sound and determines that the sound exceeds a threshold decibel value. The auxiliary unit then begins to record sounds within the car for ten seconds. The auxiliary unit then stores the ten second audio clip and compares the clip to three different audio signatures stored in the memory of the auxiliary unit. In particular, the auxiliary unit stores a first audio clip with the driver's child crying, a second audio clip with the driver's dog barking, and a third (stock) audio clip of a glass window breaking. The auxiliary unit determines that the recorded sounds match the audio clip of the driver's dog barking, so the auxiliary unit reports the detected sound to the telematics unit.

The telematics unit receives information regarding the detected sound, including the just-recorded sound of the dog barking, from the auxiliary unit. The telematics unit sends a text message to the driver notifying the driver of the vehicle conditions. For example, the text message may indicate that the driver's car has been off for thirty minutes, the temperature is 105 degrees, and a sound matching that of the driver's dog barking has been detected in the vehicle. The text message may also include the recording of the driver's dog barking. Upon receiving the text message, the driver realizes that the dog was left alone in the vehicle and quickly goes to the vehicle to retrieve the dog.

Figure 5:
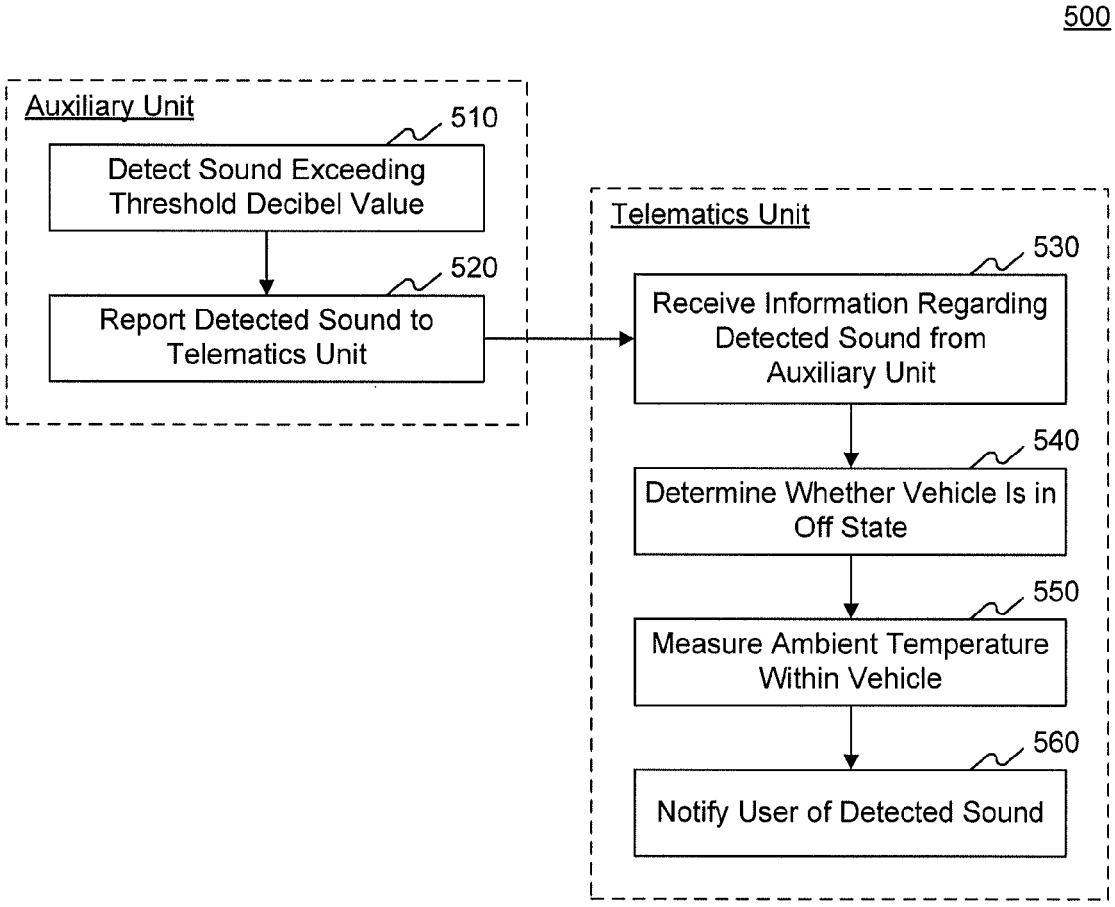
FIG. 5 illustrates another example process for notifying users of vehicle conditions, in accordance with embodiments of the present disclosure.

FIG. 5 depicts another example process 500 for notifying users of vehicle conditions, in accordance with some embodiments of the present disclosure. The steps associated with this example process may be performed by the components of FIG. 1, FIG. 2, and/or FIG. 3, although in the following description reference is made to certain components of FIG. 3 for purposes of illustration. It will be appreciated, however, that other implementations are possible and that components other than that illustrated in FIG. 3 may be utilized to implement the example method of FIG. 5.

Unlike example process 400, which is initiated by the telematics unit, example process 500 is initiated by the auxiliary unit. In particular, an auxiliary unit (e.g., auxiliary unit 330) detects a sound within a vehicle (e.g., vehicle 310) that exceeds a threshold decibel value at step 510. At step 520, the auxiliary unit reports the detected sound to a telematics unit (e.g., telematics unit 320). As discussed above with respect to process 400, the auxiliary unit may record sounds within the vehicle upon detecting a sound exceeding the threshold decibel value. These sounds may be compared to one or more audio signatures stored in a memory of the auxiliary unit. In some embodiments, the detected sound is reported to the telematics unit only if the recorded sound matches an audio signature stored in the memory of the auxiliary unit. Moreover, in certain embodiments, reporting the detected sound to the telematics unit includes sending the recorded sound to the telematics unit.

The telematics unit receives information regarding the detected sound from the auxiliary unit at step 530. In some embodiments, receiving information regarding the detected sound includes receiving an audio clip of the recorded sounds from the auxiliary unit. Moreover, in some embodiments, receiving information regarding the detected sound from the auxiliary unit wakes the telematics unit from a standby mode. At step 540 the telematics unit detects whether the vehicle is in an off state. The telematics unit measures an ambient temperature within the vehicle in step 550. If the ambient temperature within the vehicle exceeds a threshold temperature (and, in some embodiments, if the vehicle is in an off state), the telematics unit notifies a user associated with the vehicle of the detected sound at step 560.

In some embodiments, additional conditions must be present in order for the telematics unit to notify the user of the detected sound. For example, the telematics may notify the user of the detected sound only if the vehicle has been shut off for a threshold duration, or only if the vehicle is a threshold distance from the user, or only if the vehicle is locked, or only if a child seat within the vehicle is occupied. Moreover, the means by which the user is notified of the reported sound may vary. For example, the telematics unit may notify the user of the reported sound via text message or voice call. The notification—whether by text message or voice call—may include an audio clip containing the sounds recorded by the auxiliary unit.

As with example process 400, other actions may also be taken by telematics unit, in addition to notifying a user associated with the vehicle. For example, the telematics unit may notify emergency services of the reported sound. The telematics unit may lower a window of the vehicle (e.g., by one inch) to cool the vehicle. The telematics unit may also activate air conditioning in the vehicle until the vehicle returns to an ambient temperature below a threshold value.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

For example, advantageous results still could be achieved if steps of the disclosed techniques were performed in a different order or if components in the disclosed systems were combined in a different manner or replaced or supplemented by other components. Other implementations are also within the scope of the following example claims.

Therefore, it is intended that the disclosed embodiments and examples be considered as exemplary only, with a true scope of the present disclosure being indicated by the following claims and their equivalents.

What is claimed is:

1. A system for notifying users of vehicle conditions, the system comprising at least one processor configured to:

determine whether an ambient temperature associated with a vehicle exceeds a temperature threshold;

detect a sound associated with the vehicle;

record sounds upon detecting the sound associated with the vehicle;

determine a location of the vehicle;

determine a location of a user associated with the vehicle;

measure a distance between the vehicle and the user associated with the vehicle; and output a notification based on the determined ambient temperature and detected sound if the distance between the vehicle and the user associated with the vehicle is greater than a distance threshold, wherein the notification comprises the recorded sounds.

2. The system of claim 1, wherein the at least one processor is configured to output the notification only if the detected sound exceeds a decibel threshold.

3. The system of claim 1, wherein the at least one processor is further configured to:

detect whether the vehicle is in an off state; and output the notification only if the vehicle is in an off state.

4. The system of claim 1, wherein the at least one processor is further configured to:

determine whether the vehicle is locked; and output the notification only if the vehicle is locked.

5. The system of claim 1, wherein the at least one processor is further configured to:

determine whether a child seat associated with the vehicle is occupied; and output the notification only if the child seat is occupied.

6. The system of claim 1, wherein the at least one processor is further configured to output the notification by sending a text message to a mobile device of the user associated with the vehicle.

7. The system of claim 1, wherein the at least one processor is further configured to lower a window of the vehicle based on the determined ambient temperature and detected sound.

8. The system of claim 1, wherein the at least one processor is further configured to notify emergency services of the detected sound.

9. The system of claim 1, wherein the at least one processor is further configured to:

determine whether the recorded sounds match at least one audio signature; and output the notification only if the recorded sounds match the at least one audio signature.

10. The system of claim 1, wherein:

the steps of determining whether an ambient temperature associated with a vehicle exceeds a temperature threshold and outputting a notification based on the determined ambient temperature and detected sound are performed by a first processor associated with a telematics unit; and the step of detecting a sound associated with the vehicle is performed by a second processor associated with an auxiliary unit.

11. The system of claim 10, wherein:

the first processor is configured to:

send a request to the auxiliary unit to monitor sounds associated with the vehicle; and receive information regarding a detected sound from the auxiliary unit; and the second processor is configured to:

receive a request from the telematics unit to monitor sounds associated with the vehicle; and send information regarding a detected sound to the telematics unit.

12. A computer-implemented method for notifying users of vehicle conditions, the method performed by one or more processors and comprising:

determining whether an ambient temperature associated with a vehicle exceeds a temperature threshold;

detecting a sound associated with the vehicle;

recording sounds upon detecting the sound associated with the vehicle;

determining a location of the vehicle;

determining a location of a user associated with the vehicle;

measuring a distance between the vehicle and the user associated with the vehicle; and outputting a notification based on the determined ambient temperature and detected sound if the distance between the vehicle and the user associated with the vehicle is greater than a distance threshold, wherein the notification comprises the recorded sounds.

13. The computer-implemented method of claim 12, wherein the notification is outputted only if the detected sound exceeds a decibel threshold.

14. The computer-implemented method of claim 12, further comprising:

detecting whether the vehicle is in an off state; and outputting the notification only if the vehicle is in an off state.

15. The computer-implemented method of claim 12, further comprising:

determining whether the vehicle is locked; and outputting the notification only if the vehicle is locked.

16. The computer-implemented method of claim 12, further comprising:

determining whether a child seat associated with the vehicle is occupied; and outputting the notification only if the child seat is occupied.

17. The computer-implemented method of claim 12, wherein outputting the notification comprises sending a text message to a mobile device of the user associated with the vehicle.

18. The computer-implemented method of claim 12, further comprising lowering a window of the vehicle based on the determined ambient temperature and detected sound.

19. The computer-implemented method of claim 12, further comprising notifying emergency services of the detected sound.

20. The computer-implemented method of claim 12, further comprising:

determining whether the recorded sounds match at least one audio signature; and outputting the notification only if the recorded sounds match the at least one audio signature.

* * * * *